US006918324B2

(12) United States Patent
Hsien

(10) Patent No.: US 6,918,324 B2
(45) Date of Patent: Jul. 19, 2005

(54) HAND TOOL HAVING A BENDABLE HOLDING PORTION

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/638,933

(22) Filed: Aug. 8, 2003

(65) Prior Publication Data

US 2005/0028652 A1 Feb. 10, 2005

(51) Int. Cl.[7] ..... B25B 7/00
(52) U.S. Cl. ..... 81/427.5; 81/415; 30/191
(58) Field of Search ..... 81/427.5, 415, 81/385; 30/191, 192, 193, 252

(56) References Cited

U.S. PATENT DOCUMENTS 460,438 A * 9/1891 Haunty ..... 81/415
971,582 A * 10/1910 Hall ..... 81/415
1,640,883 A * 8/1927 Coleman ..... 81/427.5
2,826,106 A * 3/1958 Schegulla ..... 81/427.5
4,028,971 A * 6/1977 Budrose ..... 30/191
5,371,658 A * 12/1994 Christie ..... 81/427.5
6,551,316 B1 * 4/2003 Rinner et al. ..... 81/427.5

* cited by examiner

*Primary Examiner*—Debra S. Meislin

(57) ABSTRACT

A hand tool includes a head portion having two jaw portions, a handle portion pivotally mounted on the head portion and having two holding grips each having a first end pivotally mounted on an end of a respective one of the two jaw portions of the head portion, and a connecting rod mounted between the two holding grips of the handle portion, so that the two holding grips of the handle portion can be moved and bent relative to the two jaw portions of the head portion synchronously. Thus, the included angle between the handle portion and the head portion can be adjusted easily and rapidly.

6 Claims, 6 Drawing Sheets

HAND TOOL HAVING A BENDABLE HOLDING PORTION

BACKGROUND OF THE INVENTION

1. Field of the Invention

The present invention relates to a hand tool, such as a pair of pliers or the like, and more particularly to a hand tool having a bendable holding portion that can be bent easily and rapidly.

2. Description of the Related Art

A conventional hand tool 20, such as a pair of pliers in accordance with the prior art shown in FIGS. 7 and 8 comprises a head portion 21, and a handle portion 24 pivotally mounted on the head portion 21. The head portion 21 has two jaw portions 22 pivotally connected with each other. The handle portion 24 has two holding grips 26 each having an end pivotally mounted on an end of a respective one of the two jaw portions 22 of the head portion 21. Thus, the handle portion 24 can be bent relative to the head portion 21 so as to adjust the included angle between the handle portion 24 and the head portion 21.

However, the two holding grips 26 of the handle portion 24 cannot be moved and bent relative to the two jaw portions 22 of the head portion 21 synchronously, so that the included angle between the handle portion 24 and the head portion 21 cannot be adjusted easily and rapidly. In addition, the bent angle of each of the two holding grips 26 of the handle portion 24 is adjusted independently, so that the two holding grips 26 of the handle portion 24 are not aligned with each other easily, thereby decreasing the driving force of the handle portion 24.

SUMMARY OF THE INVENTION

The primary objective of the present invention is to provide a hand tool having a holding portion that can be bent easily and rapidly.

Another objective of the present invention is to provide a hand tool, wherein by provision of the connecting rod between the two holding grips of the handle portion, the two holding grips of the handle portion can be moved and bent relative to the two jaw portions of the head portion synchronously, so that the included angle between the handle portion and the head portion can be adjusted easily and rapidly.

A further objective of the present invention is to provide a hand tool, wherein the two holding grips of the handle portion have the same bent angle by provision of the connecting rod, thereby enhancing the driving force of the handle portion, so that the two jaw portions of the head portion can be used to clamp the workpiece rigidly and stably.

A further objective of the present invention is to provide a hand tool, wherein when the user unintentionally touches one of the two holding grips of the handle portion, the two holding grips of the handle portion have the same bent angle by provision of the connecting rod, so that the driving force of the handle portion will not be affected.

A further objective of the present invention is to provide a hand tool, wherein when the two holding grips of the handle portion are pressed to move toward each other, the second end of the connecting rod is slidable in and protruded outward from the second end of the respective holding grip of the handle portion, so that the user's fingers can hold the second end of the connecting rod so as to provide a stopping effect, thereby facilitating the user operating the hand tool.

In accordance with the present invention, there is provided a hand tool, comprising:

a head portion having two jaw portions;

a handle portion pivotally mounted on the head portion and having two holding grips each having a first end pivotally mounted on an end of a respective one of the two jaw portions of the head portion; and a connecting rod mounted between the two holding grips of the handle portion, so that the two holding grips of the handle portion can be moved synchronously.

Further benefits and advantages of the present invention will become apparent after a careful reading of the detailed description with appropriate reference to the accompanying drawings.

DETAILED DESCRIPTION OF THE INVENTION

Figure 1:
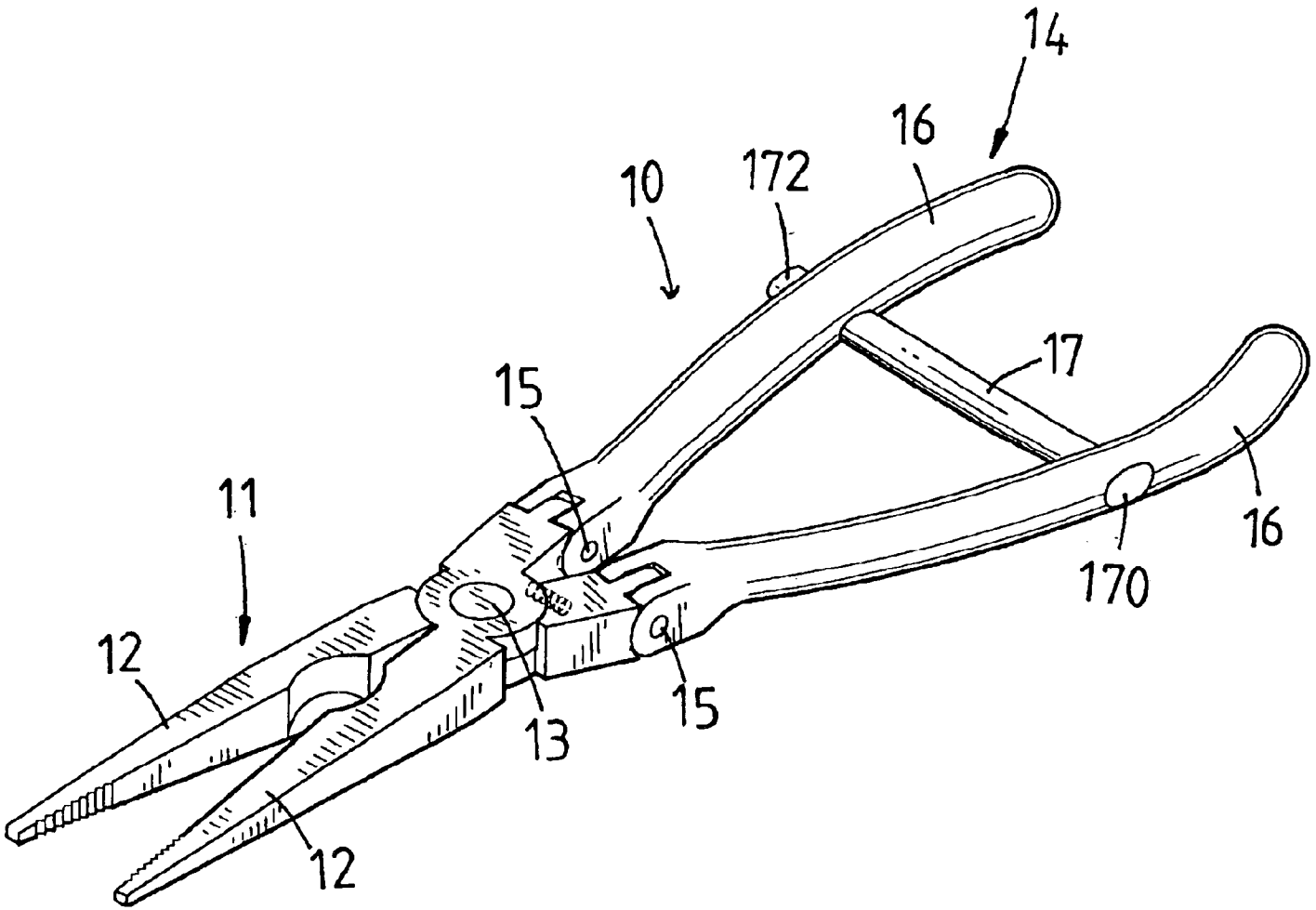
FIG. 1 is a perspective view of a hand tool in accordance with the preferred embodiment of the present invention.
Figure 2:
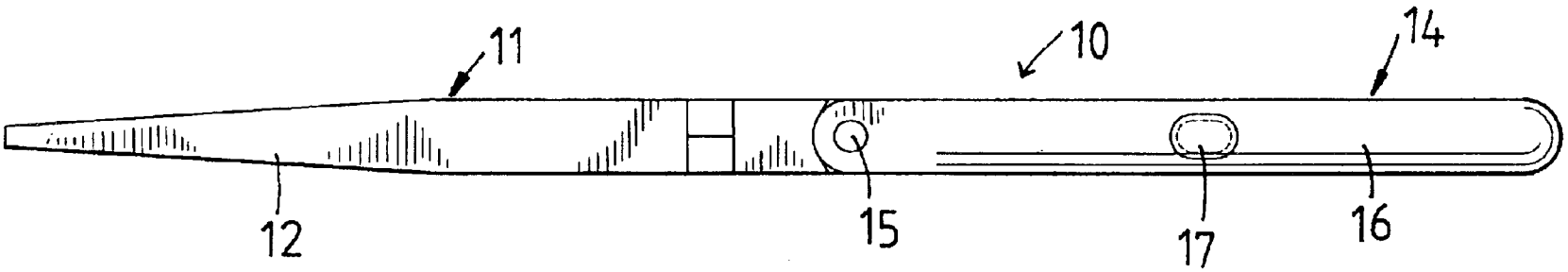
FIG. 2 is a side plan view of the hand tool as shown in FIG. 1.
Figure 3:
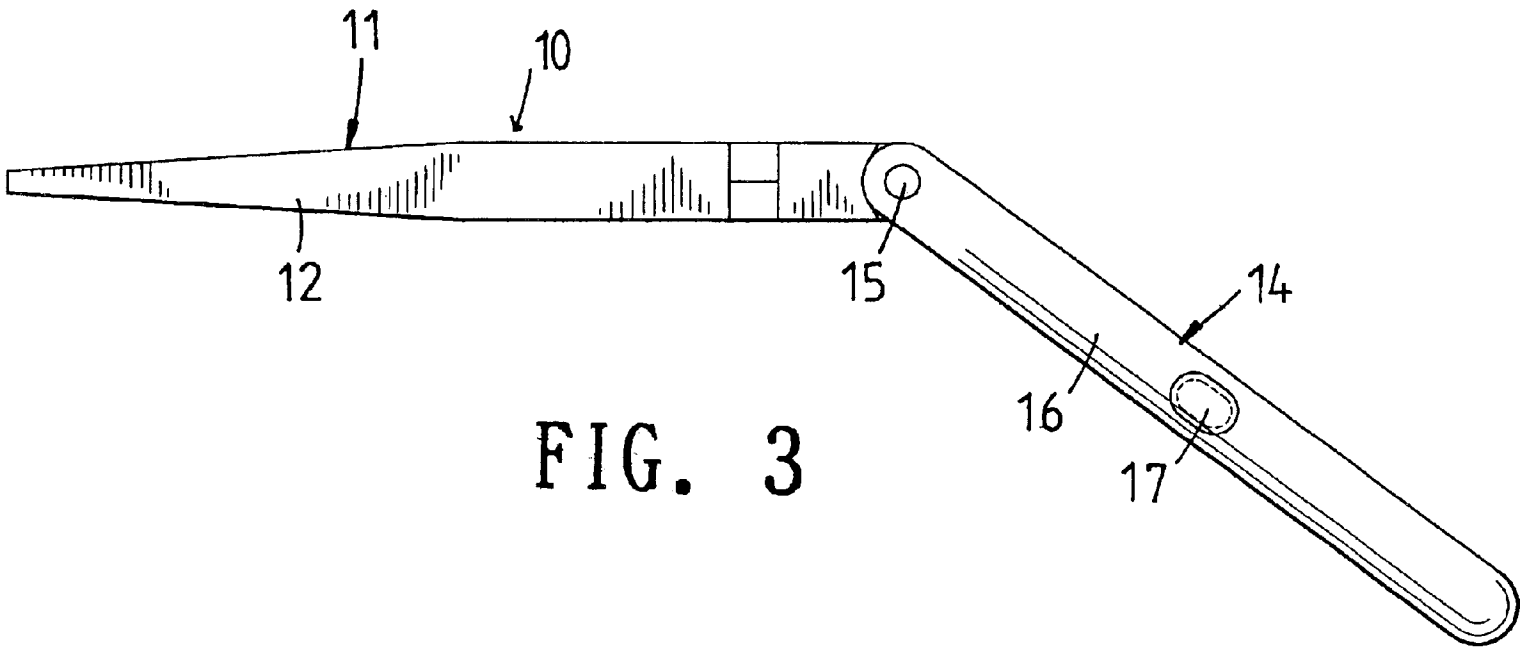
FIG. 3 is a schematic operational view of the hand tool as shown in FIG. 2 in use.

Referring to the drawings and initially to FIGS. 1–3, a hand tool 10, such as a pair of pliers in accordance with the preferred embodiment of the present invention comprises a head portion 11, and a handle portion 14 pivotally mounted on the head portion 11.

The head portion 11 has two jaw portions 12 pivotally connected with each other by a pivot pin 13.

The handle portion 14 has two holding grips 16 each having a first end pivotally mounted on an end of a respective one of the two jaw portions 12 of the head portion 11 by a positioning pin 15. Thus, the handle portion 14 can be bent relative to the head portion 11 to adjust the included angle between the handle portion 14 and the head portion 11.

The hand tool 10 further comprises a connecting rod 17 mounted between the two holding grips 16 of the handle portion 14, so that the two holding grips 16 of the handle portion 14 can be moved synchronously. Thus, the two holding grips 16 of the handle portion 14 can be bent relative to the two jaw portions 12 of the head portion 11 synchronously.

Preferably, the connecting rod 17 has two ends each extended through a second end of a respective one of the two holding grips 16 of the handle portion 14.

Preferably, the connecting rod 17 has a first end 170 secured in the second end of one of the two holding grips 16 of the handle portion 14 and a second end 172 slidably mounted in and protruded outward from the second end of the other one of the two holding grips 16 of the handle portion 14.

Figure 4:
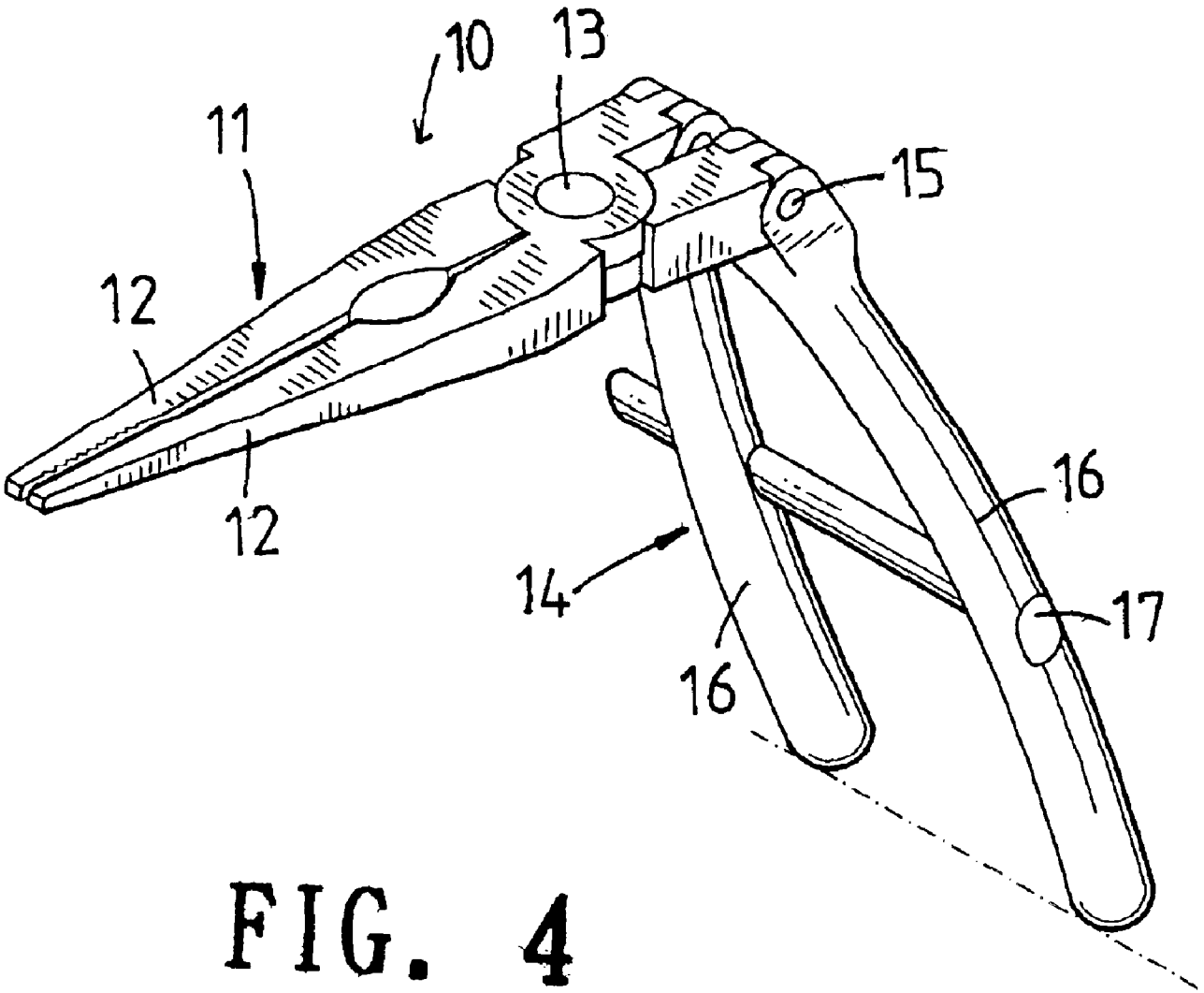
FIG. 4 is a schematic operational view of the hand tool as shown in FIG. 1 in use.

Referring to FIGS. 2–4, by provision of the connecting rod 17 between the two holding grips 16 of the handle portion 14, the two holding grips 16 of the handle portion 14 can be moved and bent relative to the two jaw portions 12 of the head portion 11 synchronously, so that the included angle between the handle portion 14 and the head portion 11 can be adjusted easily and rapidly.

In addition, the two holding grips 16 of the handle portion 14 have the same bent angle by provision of the connecting rod 17, thereby enhancing the driving force of the handle portion 14, so that the two jaw portions 12 of the head portion 11 can be used to clamp the workpiece rigidly and stably.

Further, when the user unintentionally touches one of the two holding grips 16 of the handle portion 14, the two holding grips 16 of the handle portion 14 have the same bent angle by provision of the connecting rod 17, so that the driving force of the handle portion 14 will not be affected.

Figure 6:
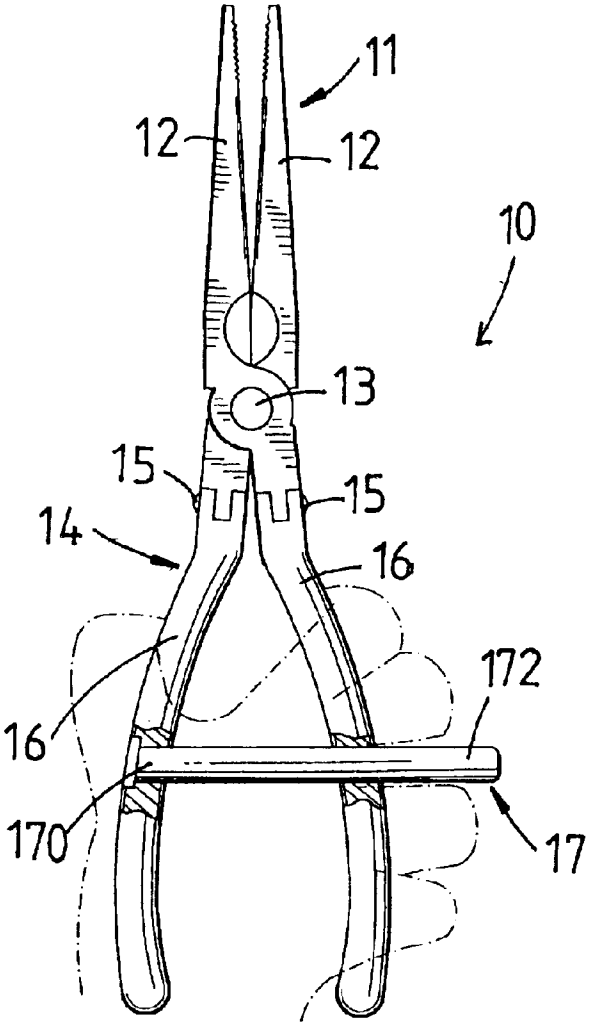
FIG. 6 is a schematic operational view of the hand tool as shown in FIG. 5 in use.
Figure 5:
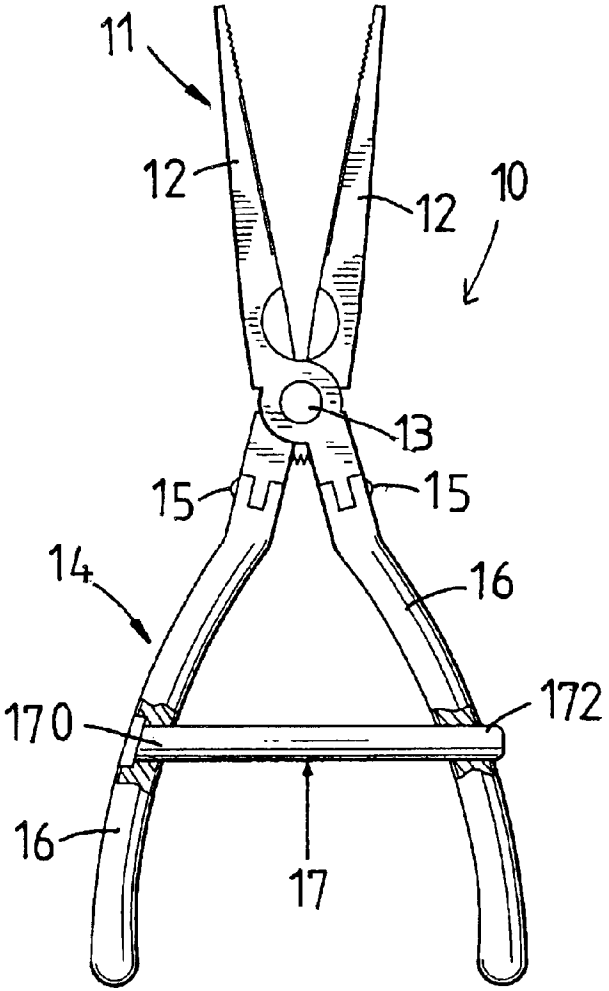
FIG. 5 is a top plan view of the hand tool as shown in FIG. 1.
Figure 7:
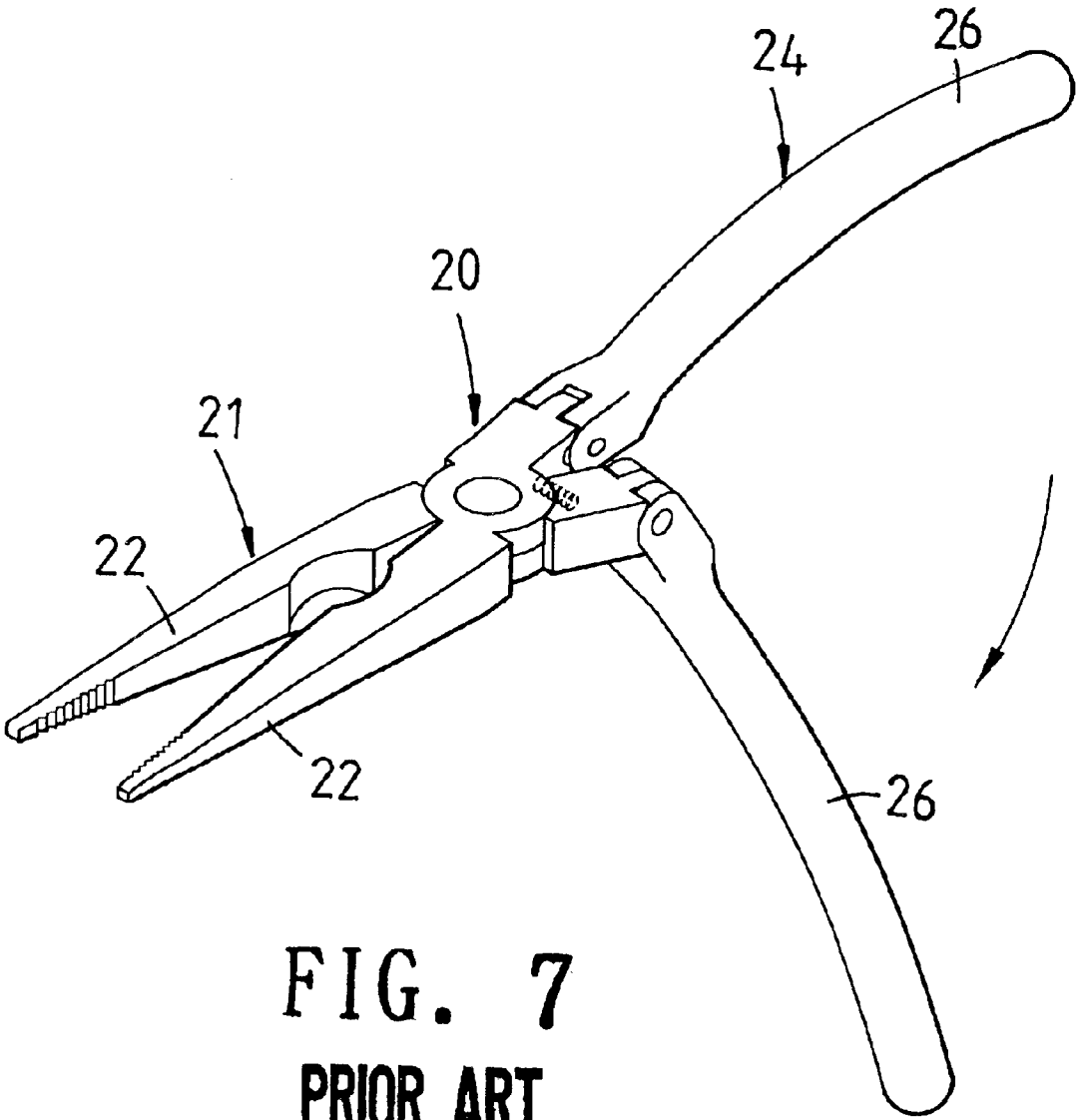
FIG. 7 PRIOR ART
FIG. 7 is a perspective view of a conventional hand tool in accordance with the prior art.
Figure 8:
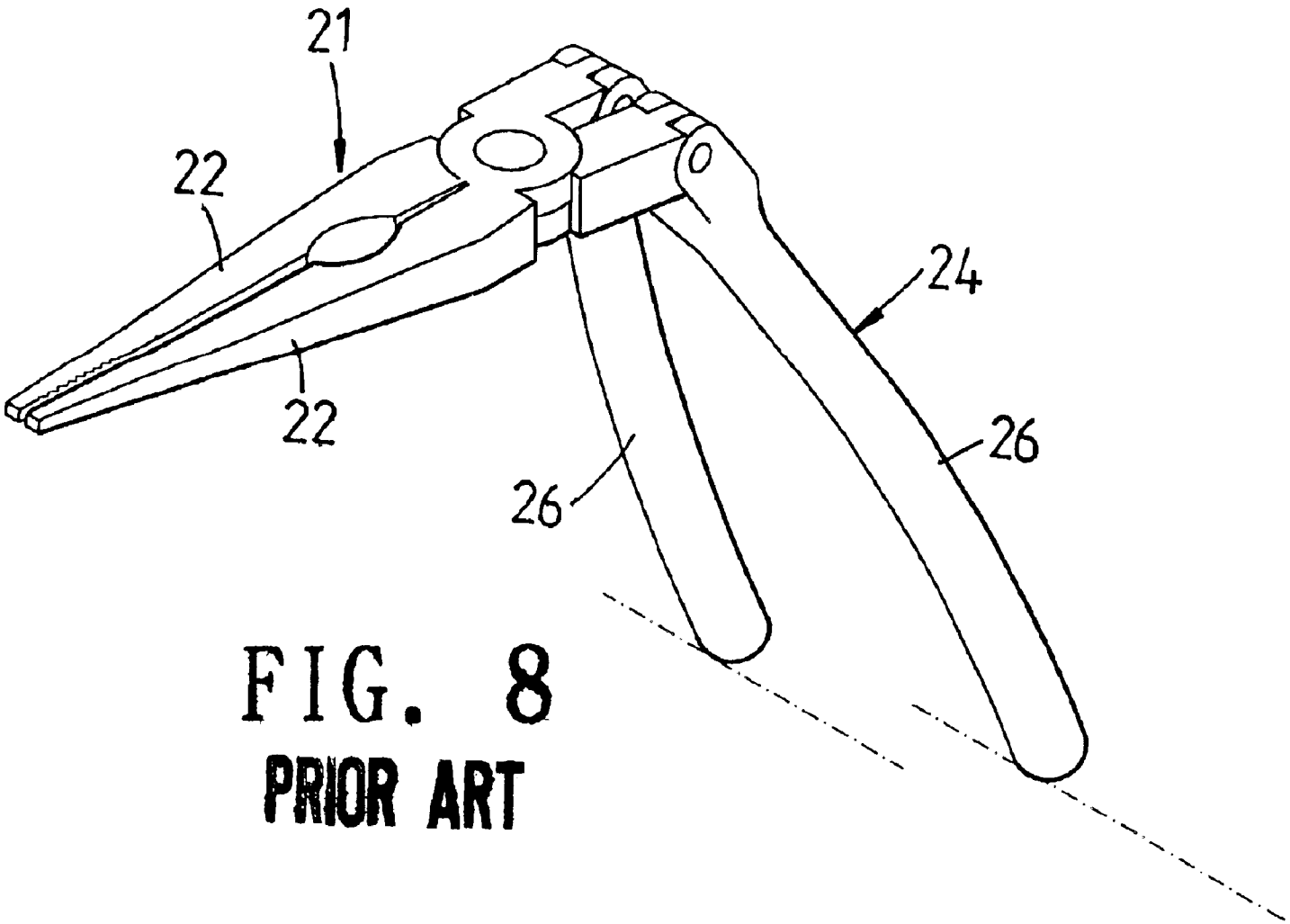
FIG. 8 PRIOR ART
FIG. 8 is a perspective view of the conventional hand tool in accordance with the prior art.

Referring to FIGS. 5 and 6, when the two holding grips 16 of the handle portion 14 are pressed to move toward each other, the second end 172 of the connecting rod 17 is slidable in and protruded outward from the second end of the respective holding grip 16 of the handle portion 14 as shown in FIG. 6, so that the user's fingers can hold the second end 172 of the connecting rod 17 so as to provide a stopping effect, thereby facilitating the user operating the hand tool 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hand tool, comprising:

a head portion having two jaw portions;

a handle portion pivotally mounted on the head portion and having two holding grips each having a first end pivotally mounted on an end of a respective one of the two jaw portions of the head portion; and a connecting rod mounted between the two holding grips of the handle portion, so that the two holding grips of the handle portion can be moved synchronously;

wherein, the connecting rod has two ends each extended through a second end of a respective one of the two holding grips of the handle portion;

the connecting rod has a first end fixedly secured on the second end of one of the two holding grips of the handle portion and a smooth second end slidably mounted in and protruded outward from the second end of the other one of the two holding grips of the handle portion.

2. The hand tool in accordance with claim 1, wherein the two jaw portions of the head portion are pivotally connected with each other by a pivot pin.

3. The hand tool in accordance with claim 1, wherein each of the two holding grips of the handle portion is pivotally mounted on a respective one of the two jaw portions of the head portion by a positioning pin.

4. The hand tool in accordance with claim 1, wherein the two holding grips of the handle portion can be bent relative to the two jaw portions of the head portion synchronously.

5. The hand tool in accordance with claim 1, wherein when the two holding grips of the handle portion are pressed to move toward each other, the second end of the connecting rod is slidable in and protruded outward from the second end of the respective holding grip of the handle portion.

6. The hand tool in accordance with claim 1, wherein the first end of the connecting rod has an enlarged stepped head fixedly secured in a stepped hole of the second end of one of the two holding grips of the handle portion.

* * * * *